United States Patent [19]

Celmayster et al.

[11] Patent Number: 4,802,647

[45] Date of Patent: Feb. 7, 1989

[54] TRASH BAG HOLDER

[76] Inventors: James M. Celmayster, 1238 Nopal St., Santa Barbara, Calif. 93103; Alain J-M Clenet, 1211 Harbor Hill Dr., Santa Barbara, Calif. 93109

[21] Appl. No.: 58,033

[22] Filed: Jun. 4, 1987

[51] Int. Cl.[4] ..... A63B 55/04

[52] U.S. Cl. ..... 248/544; 248/97; 248/99

[58] Field of Search ..... 248/544, 95, 97, 99, 248/100, 101, 153, 165, 166, 172, 175; 141/316, 390, 391; 53/390; 220/1 T, 401, 404

[56] References Cited

U.S. PATENT DOCUMENTS

| | | | |
|---|---|---|---|
| 1,653,393 | 12/1927 | Cox . | |
| 2,470,977 | 5/1949 | Chidsey, Jr. | 248/97 |
| 3,633,859 | 1/1972 | Vosbikian . | |
| 3,806,146 | 4/1974 | Shaw | 248/95 X |
| 3,826,455 | 7/1974 | O'Donnell . | |
| 4,199,122 | 4/1980 | Christie . | |
| 4,332,361 | 6/1982 | McClellan . | |
| 4,364,534 | 12/1982 | Valesko . | |
| 4,458,867 | 7/1984 | Malik | 248/99 X |
| 4,467,989 | 8/1984 | Stroh | 248/153 X |
| 4,638,968 | 1/1987 | Auten | 248/97 |
| 4,667,912 | 5/1987 | DeVilbiss | 248/153 X |

FOREIGN PATENT DOCUMENTS

| | | | |
|---|---|---|---|
| 754064 | 8/1956 | United Kingdom | 248/95 |

*Primary Examiner*—J. Franklin Foss
*Assistant Examiner*—Robert A. Olson
*Attorney, Agent, or Firm*—Brooks & Kushman

[57] ABSTRACT

A trash bag holder (10) for holding a looped handle trash bag (12) is disclosed as including a pair of inverted U-shaped supports (16) supported by a pair of elongated bases (18). Each support (16) includes a pair of vertical legs (22) and an upper connecting portion (24) that extends between the legs. Upper bight portions (26) of the legs and ends (30) of each connecting portion (24) cooperate to define notches (31) that receive looped handles (14) of the trash bag to secure the bag handles. Lower distal ends (28) of the support legs are received within connection holes (34) in the base ends such that the bases (18) extend in a spaced and parallel relationship to each other to facilitate use of the holder on obstructed floor spaces. The supports (16) are preferably manufactured from bent metal wire while the bases (18) are preferably manufactured as injection moldings, with interfitting formations (36) and (38) of the supports and bases providing convenient storage of the trash bag holder.

10 Claims, 3 Drawing Sheets

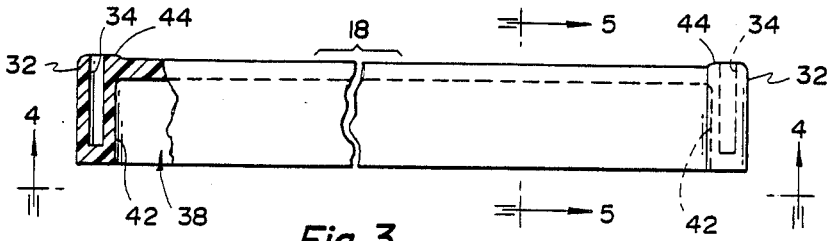
Fig. 3
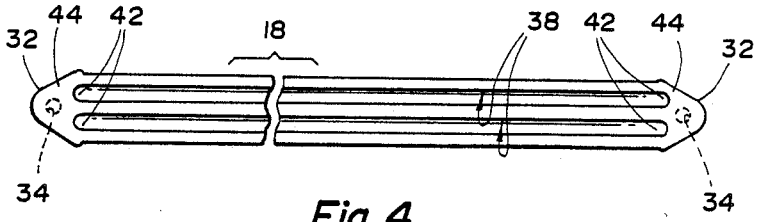
Fig. 4
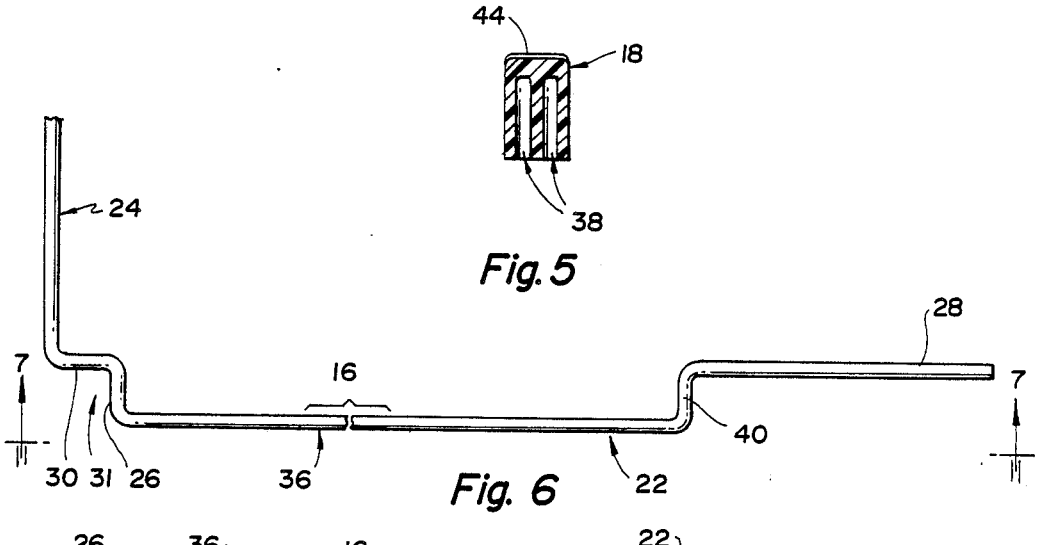
Fig. 5
Fig. 6
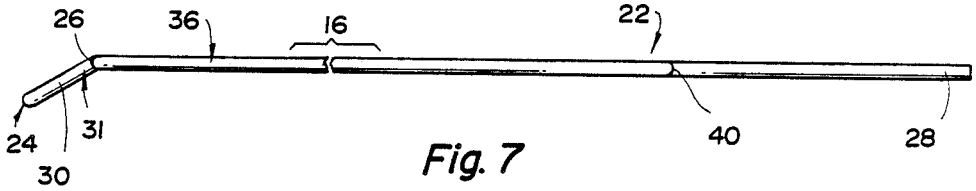
Fig. 7

TRASH BAG HOLDER

TECHNICAL FIELD

This invention relates to an improved trash bag holder for holding plastic trash bags of the type having a pair of looped handles.

BACKGROUND ART

Prior to the introduction of plastic bags, garbage and other trash were normally disposed of in paper bags. Such paper bags were usually obtained from grocery stores during shopping trips and after emptying were utilized by lining of waste baskets or other trash receptacles to eliminate the necessity of a cleaning operation when messy trash was involved. Grocery stores have recently attempted to convert from the use of paper bags to plastic bags having looped handles in view of the tremendous cost savings involved. This is particularly important for grocery stores in view of the low profit volume of the grocery industry. However, there has been some reluctance to such conversion due to the widespread and long usage of paper bags as discussed above.

U.S. Pat. 1,653,393 of Cox discloses a bag holder having a pair of inverted U-shaped members that are connected by an upper hinge structure and inserted within a bag to hold the bag open during filling. Such a structure is not particularly desirable because the inverted U-shaped members are directly exposed to messy waste and thus must be cleaned after removal from the filled bag.

U.S. Pat. Nos. 3,633,859 Vosbikian; 3,826,455 O'Donnell; and 4,364,534 Valesko disclose bag holders having inverted U-shaped members that are supported by bases which extend across the U-shaped openings of the inverted U-shaped members to provide upwardly projecting support thereto during use. Specifically, the Vosbikian patent has bases that extend diagonally with respect to the supports in a crossing relationship with each other, while the O'Donnell patent has a solid base and the Valesko patent has a rectangular wire base. Each of these types of bases make it difficult to store the bag holder in certain obstructed spaces such as underneath a kitchen sink where the bag holder may have to straddle a floor obstruction or another object stored below the sink.

U.S. Pat. No. 4,199,122 Christie and 4,332,361 McClellan disclose bag holders for trash bags having looped handles. In the Christie patent, the trash bag holder has a welded wire construction that opens forwardly and upwardly with a construction that does not particularly lend itself to compact storage. In the McClellan patent, the bag holder is designed to be mounted on a vertical wall or door and thus cannot be used standing along such as below a kitchen sink.

DISCLOSURE OF INVENTION

An object of the present invention is to provide an improved trash bag holder for holding looped handle type trash bags with a construction that is economical to manufacturer, capable of use on obstructed floor spaces, compactly storable and effective in use so as to promote the use of looped handle trash bags of the type presently being promoted by the grocery industry.

In carrying out the above object, a trash bag holder constructed in accordance with the present invention, includes a pair of U-shaped supports each of which has a pair of generally vertically extending legs and an upper connecting portion that extends between the legs. Each support has each leg thereof provided with an upper bight portion adjacent the connecting portion and each leg also has a lower distal end remote from the connection portion. The connecting portion of each support has a laterally elongated U-shaped configuration and has laterally spaced ends that cooperate with the upper bight portions of the legs connected thereto to define support notches for receiving a trash bag handle looped over the connecting portion with the trash bag held open between the supports. A pair of elongated bases of the trash bag holder extend between the pair of supports in a spaced and parallel relationship to each other. Each base has opposite ends including connection holes that respectively receive distal leg ends of both inverted U-shaped supports such that the supports position the bases in a spaced relationship to each other and are supported thereby to receive and support the trash bag whose handles are looped over the connecting portions.

The connection portions of the supports are inclined with respect to the legs away from each other. This inclination of the connecting portions prevents the bag handles from slipping off the supports.

The legs of the supports and the bases have interfitting light formations that allow storage of the supports and bases with respect to each other prior to use or when use is otherwise not necessary. More specifically, the legs are disclosed as having lower bight portions that cooperated with the upper bight portions to provide the formations of the legs, and each base has a pair of slots that constitute the formations thereof and receive the leg formations to locate the supports and bases with respect to each other for compact shipping and storage.

The bases of the trash bag holder are disclosed as having upper sides in which the connection holes are provided at the ends thereof, and the bases are also disclosed as having lower sides in which the slots thereof are provided such that the slots are hidden from sight during use. These slots of each base portion are disclosed as having opposite ends located adjacent the connection holes of the base ends, and the base ends preferably have pointed shapes that are rounded adjacent the connection holes.

The distal ends of the legs and the connection holes of the base are preferably round so as to provide pivotal connections for permitting adjustment of the spacing between the bases.

Each inverted U-shaped support is preferably bent from metal wire to define it's legs and connecting portion with a construction that is economical to manufacture while still being of high strength for use. The bent wire supports can be painted, chromed, or otherwise suitably covered to enhance the aesthetic appeal of the trash bag holder.

In the preferred construction, the elongated bases are plastic injection moldings that provide an economical construction capable of forming the connection holes and slots of the preferred construction for storing the supports and bases with respect to each other.

The objects, features, and advantages of the present invention are readily apparent from the following detail description of the best mode for carrying out the invention when taken in connection with the accompanied drawings.

BRIEF DESCRIPTION OF DRAWINGS

FIG. 3 is a partially broken away side elevational view of one of the bases of the trash bag holder;

FIG. 4 is a bottom plan view of the base taken along the direction of line 4—4 in FIG. 3;

FIG. 5 is a cross sectional view of the base taken along the direction of line 5—5 in FIG. 3;

FIG. 6 is a half end view of one of the U-shaped supports of the trash bag holder;

FIG. 7 is a side view of the support taken along the direction of line 7—7 in FIG. 6;

BEST MODE FOR CARRYING OUT THE INVENTION

Figure 1:
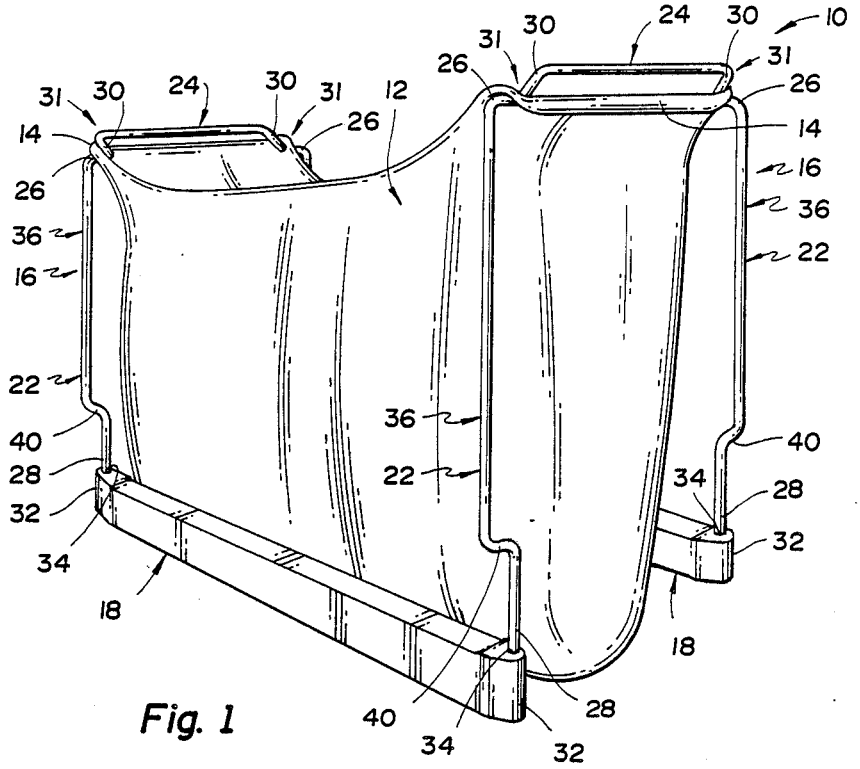
FIG. 1 is a perspective view of a trash bag holder constructed in accordance with the present invention and shown in a use position with inverted U-shaped wire supports thereof mounted by a pair of spaced bases to support a looped handle trash bag for receiving trash.
Figure 2:
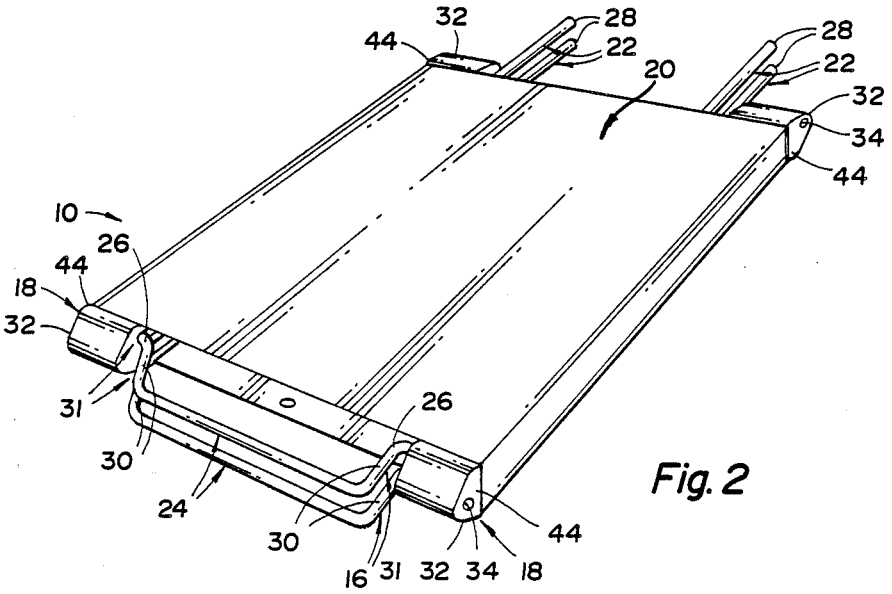
FIG. 2 is a perspective view that illustrates the U-shaped supports and bases of the trash bag holder stored with respect to each other for shipment or when use is not necessary.

With reference to FIG. 1 of the drawings, a trash bag holder constructed in accordance with the present invention is generally indicated by 10 and is illustrated in an assembled condition as is hereinafter more fully described with a trash bag 12 having looped handles 14 supported by the holder so as to open upwardly to receive trash and other wastes to be disposed of as necessary. This trash bag holder 10 includes a pair of inverted U-shaped supports 16 and a pair of elongated base members 18 that mount the supports 16 in the upright position shown. Prior to assembly of the trash bag holder 10 as illustrated in FIG. 1, the U-shaped supports 16 and the elongated bases 18 are stored for shipment with respect to each other as shown in FIG. 2 with a storage band 20 extending around the bases as is hereinafter more fully described.

With combined reference to FIGS. 1, 6, and 7, each U-shaped support 16 is preferably manufactured by bending metal wire of a suitable diameter and includes a pair of generally vertically extending legs 22 and an upper connecting portion 24 that extends between the legs. Each support 16 has each leg 22 thereof provided with an upper bight portion 26 adjacent the connecting portion 24, and each leg also has a lower distal end 28 remote from the connecting portion. The connecting portion 24 of each support 16 has a laterally elongated U-shaped configuration and laterally spaced ends 30 of each connecting portion 24 cooperate with the upper bight portions 26 of the legs 22 to define support notches 31 for receiving one of the trash bag handles 14 looped over the adjacent connecting portion 24 as illustrated in FIG. 1. The connecting portions 24 are preferably inclined with respect to the in a direction away from each other with an inclination of about 30 degrees with respect to the legs 22. This inclination helps to prevent unintended detachment of the bag handles 14 from the connecting portions 24 in the supported position shown in FIG. 1.

With combined reference to FIGS. 1 and 3 through 5, the pair of elongated bases 18 are preferably made as plastic injection moldings and in the assembled position of FIG. 1 extend between the pair of supports in a spaced and parallel relationship to each other. Each base 18 has opposite ends 32 including associated connection holes 34 that receive distal leg ends 28 of both inverted U-shaped supports 16 such that the supports space the bases from each other and are supported thereby to receive and support the trash bag 12 whose handles 14 are looped over the inclined connection portions 24 as previously described.

As shown in FIGS. 1 and 7, the connecting portions 24 are preferably inclined away from each other with an inclination of about 30 degrees with respect to the legs 22. This inclination helps to prevent unintended detachment of the bag handles 14 from the connecting portions 24 in the supported position shown in FIG. 1.

As illustrated in FIGS. 1, 4, and 6, the legs 22 of the supports 16 and the bases 18 have interfitting bight formations 36 and 38 that allow the storage of the supports and bases with respect to each other as shown in FIG. 2. This storage is desirable for shipment and storage prior to use and is also desirable when use of the trash bag holder is otherwise not necessary. More specifically, the legs 22 as shown in FIGS. 1 and 6 have lower bight portions 40 that cooperate with the upper bight portions 26 to provide the formations 36 thereof which project laterally outwardly away from each other. Furthermore, the formations 38 of each base 18 comprise a pair of elongated slots as best shown in FIGS. 4 and 5 such that these slots receive the leg formations 36 in the storage position as shown in FIG. 2. Interfitting of the bight portion formations 36 of the legs and the slot formations 38 of the bases thus locates the supports and the bases with respect to each other in a convenient manner.

As shown by combined reference to FIGS. 3 through 5, the bases 18 have upper sides in which the connection holes 34 are provided at the ends 32 thereof and have lower sides in which the slots 38 are provided. These slots 38 have opposite ends 42 located adjacent the connection holes 34 of the base ends 32. Each of the base ends 32 as shown in FIG. 4 has a pointed shape that is rounded adjacent the associated connection hole 34. In cross section as illustrated in FIG. 5, each base 18 has a generally M-shaped configuration that readily lends manufacturing of the bases as injection moldings without any excessive mass that would set up warping stresses upon cooling after the initial molding.

As shown in FIGS. 2, 3, and 5, the upper side of each base 18 has its ends 32 provided with slightly upwardly extending projections 44 between which a slight recess is formed to facilitate the positioning and holding of the supports 16 and bases 18 by the band 20 illustrated in FIG. 2. This band 20 may be a shrink plastic, a cardboard secured by adhesive, stapling, or any other type of suitable securement. Likewise, after the initial assembly to the FIG. 1 position, the trash bag holder 10 may be disassembled and stowed in the FIG. 2 position with any suitable type of securement wrapped around the bases such as a cord, a large rubber band, etc.

Figure 8:
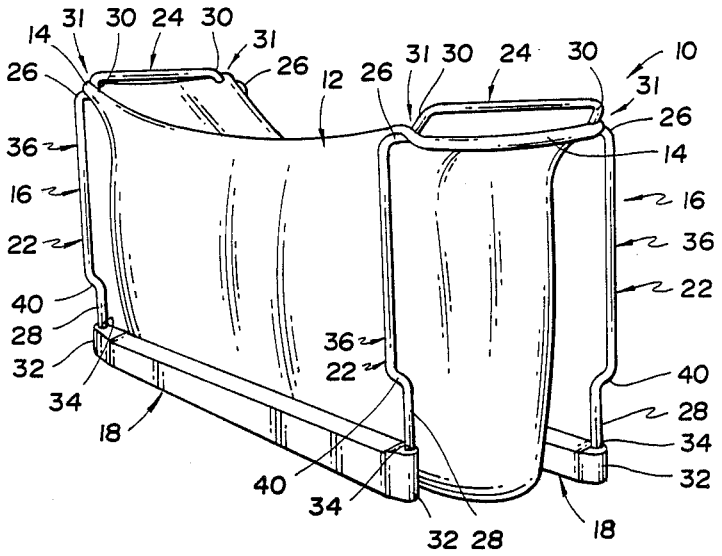
FIG. 8 is a perspective view of the trash bag holder shown generally as in FIG. 1 but illustrated with the bases adjusted so as to be spaced closer to each other.
Figure 9:
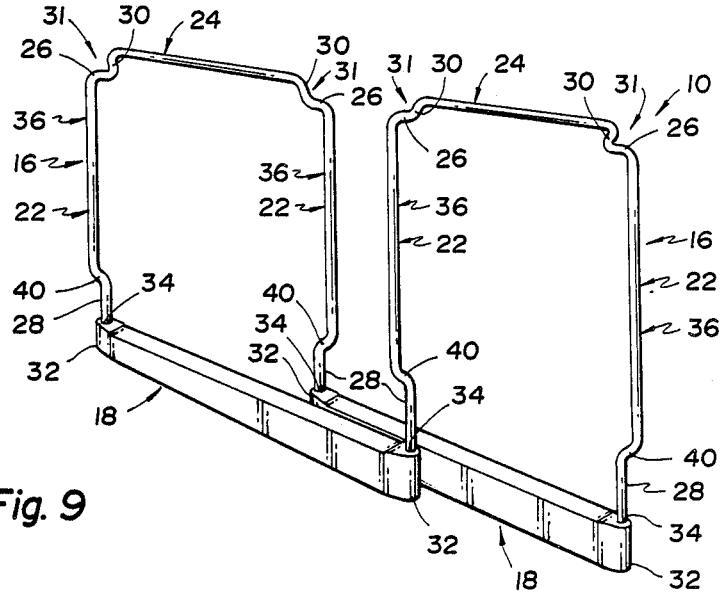
FIG. 9 is a perspective view of the trash bag holder positioned with its bases adjacent each other for storage.
Figure 10:
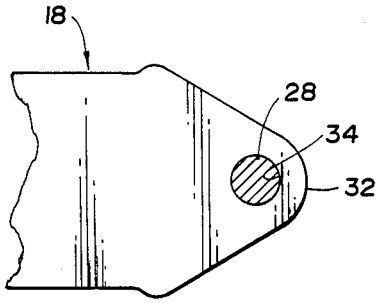
FIG. 10 is a partial view that shows the construction of pivotal connections that permit the base adjustment of the trash bag holder.

As illustrated in FIGS. 8 and 9, the construction of the trash bag holder permits adjustment of the spaced relationship between the bases 18. This adjustment is permitted by the construction illustrated in FIG. 10 of the distal leg ends 28 and the base connection holes 34 which are both round so as to thereby provide pivotal connections between the supports 16 and the bases 18. These pivotal connections allow the bases 18 to be adjusted toward each other from the position shown in FIG. 1 to the position shown in FIG. 8 when the width of the space in which the trash bag holder 10 is used is somewhat confined, such as is often the case in the area below a kitchen sink. In this inwardly adjusted position, one end of each base 18 projects longitudinally past the adjacent end of the other base and the bases cooperate with the supports 16 in defining a somewhat parallelogram configuration. Further inward adjustment of the bases 18 to the position of FIG. 9 with the bases located adjacent each other permits storage of the trash bag holder 10 when use is hot required.

The bent wire supports 26 may be painted, coated with chrome, or otherwise suitably covered to provide an aesthetically appealing appearance.

While the best mode for carrying out the invention has been described in detail, those familiar with the art to which this invention relates will recognize various alternative designs and embodiments for practicing the invention as defined by the following claims.

What is claimed is;

1. A trash bag holder comprising: a pair of inverted U-shaped supports each of which has a pair of generally vertically extending legs and an upper connecting portion that extends between the legs; each support having each leg thereof provided with an upper bight portion adjacent the connecting portion and each leg also having a lower distal end remote from the connecting porton; the connecting portion of each support having a laterally elongated U-shaped configuration that is inclined with respect to the legs and has laterally spaced ends that cooperate with the upper bight portions of the legs connected thereto to define support notches for receiving a trash bag handle looped over the connecting portion; the legs of each support having lower bight portions that cooperate with the upper bight portions to provide bight formations of the legs; a pair of elongated bases that each extend between the pair of supports in a spaced and parallel relationship to each other; each base having opposite ends including connection holes that respectively receive distal leg ends of both inverted U-shaped supports such that the supports position the bases in a spaced relationship to each other and are supported thereby with the connecting portions inclined away from each other such that the support notches receive and support the trash bag whose handles are looped over the inclined connecting portions; and each base having a pair of slots that receive the bight formations to locate the supports and bases with respect to each other prior to use and for storage when use is not necessary.

2. A trash bag holder as in claim 1 wherein the bases have upper sides in which the connection holes are provided at the ends thereof, and the bases having lower sides in which the slots thereof are provided.

3. A trash bag holder as in claim 2 wherein the slots of each base portion have opposite ends located adjacent the connection holes of the base ends.

4. A trash bag holder as in claim 3 wherein the base ends have pointed shapes that are rounded adjacent the connection holes.

5. A trash bag holder as in claim 1 wherein the distal ends of the legs and the connection holes of the base are 'round so as to provide pivotal connections for permitting adjustment of the spacing between the bases.

6. A trash bag holder as in any preceding claim wherein the each inverted U-shaped support is bent from metal wire to define its legs and connecting portion.

7. A trash bag holder as in any one of claims 1, and 2 through 5 wherein the bases are plastic injection moldings.

8. A trash bag holder comprising: a pair of inverted U-shaped bent wire supports each of which has a pair of generally vertically extending legs and an upper connecting portion that extends between the legs; each wire support having each leg thereof provided with an upper bight portion adjacent the connection portion; each leg also having a lower distal end of a round shape; the connecting portion of each wire support having a laterally elongated U-shaped configuration and being inclined in a direction away from the other wire support; each connecting portion having laterally spaced ends that cooperate with the upper bight portions of the legs connected thereto to define support notches for receiving a trash bag handle looped over the connection portion; a pair of elongated bases that extend between the pair of wire supports in a spaced and parallel relationship to each other; each base having opposite ends including round connection holes that respectively receives the round distal leg ends of both inverted U-shaped wire supports to provide pivotal connections that mount the supports on the bases so as to be capable of receiving and supporting the trash bag whose handles are looped over the inclined connecting portions; the pivotal connections permitting adjustment of the spacing between the bases; and each base having at least one slot adapted to receive one of said supports to locate the supports and bases with respect to each other prior to use and for storage when use is not necessary.

9. A trash bag holder comprising: a pair of inverted U-shaped bent wire supports each of which has a pair of generally vertically extending legs and an upper connecting portion that extends between the legs; each wire support having each leg thereof provided with an upper bight portion adjacent the connecting portion and each leg also having a lower bight portion that cooperates with the upper bight portion to define a laterally outwardly projecting formation; each leg also having a lower distal end located below the lower bight portion thereof at a remote location from the connecting portion; the connecting portion of each wire support having a laterally elongated U-shaped configuration and being inclined in a direction away from the other wire support; each connecting portion having laterally spaced ends that cooperate with the upper bight portions of the legs connected thereto to define support notches for receiving a trash bag handle looped over the connecting portion; a pair of elongated bases that are made as plastic injection moldings and extend between the pair of wire supports in a spaced and parallel relationship to each other; each base having opposite ends including connection holes that respectively receive distal leg ends of both inverted U-shaped wire supports such that the supports space the bases from each other and are supported thereby to receive and support the trash bag whose handles are looped over the inclined connecting portions; and each base having a pair of slots that receive the outwardly projecting formations of the legs to store the wire supports and bases with respect to each other.

10. A trash bag holder comprising: a pair of inverted U-shaped wire bent supports each of which has a pair of generally vertically extending legs and an upper connecting portion that extends between the legs; each wire support having each leg thereof provided with an upper bight portion adjacent the connecting portion and each leg also having a lower bight portion that cooperates with the upper bight portion to define a laterally outwardly projecting formation; each leg also having a lower distal end of a round shape located below the lower bight portion thereof at a remote location from the connecting portion; the connecting portion of each wire support having a laterally elongated U-shaped configuration and being inclined in a direction away from the other wire support; each connecting portion having laterally spaced ends that cooperate with the upper bight portions of the legs connected thereto to define support notches for receiving a trash bag handle looped over the connecting portion; a pair of elongated bases that are made as plastic injection moldings and extend between the pair of wire supports in a spaced and parallel relationship to each other; each base having an upper side with opposite ends including round connection holes that respectively receive the round distal leg ends of both inverted U-shaped wire supports to provide pivotal connections that mount the supports on the bases so as to be capable of receiving and supporting the trash bag whose handles are looped over the inclined connecting portions; the pivotal connections permitting adjustment of the spacing between the bases; and each base having a lower side including a pair of slots that receive the outwardly projecting formations of the legs to store the wire supports and bases with respect to each other.

* * * * *